US005529461A

United States Patent [19]

Kawaguchi et al.

[11] Patent Number: 5,529,461

[45] Date of Patent: Jun. 25, 1996

[54] PISTON TYPE VARIABLE DISPLACEMENT COMPRESSOR

[75] Inventors: Masahiro Kawaguchi; Masanori Sonobe; Tomohiko Yokono; Ken Suitou, all of Kariya, Japan

[73] Assignee: Kabushiki Kaisha Toyoda Jidoshokki Seisakusho, Kariya, Japan

[21] Appl. No.: 361,642

[22] Filed: Dec. 22, 1994

Related U.S. Application Data

[63] Continuation-in-part of Ser. No. 255,043, Jun. 7, 1994.

[30] Foreign Application Priority Data

Dec. 27, 1993 [JP] Japan ..... 5-332137

[51] Int. Cl.[6] ..... F04B 1/29

[52] U.S. Cl. ..... 417/222.2; 417/269

[58] Field of Search ..... 417/222.1, 222.2, 417/269, 295, 516; 91/480, 499

[56] References Cited

U.S. PATENT DOCUMENTS

| | | | |
|---|---|---|---|
| 4,669,272 | 6/1987 | Kawai et al. | 417/270 |
| 4,691,526 | 9/1987 | Kobayashi et al. | 417/269 |
| 4,801,248 | 1/1989 | Tojo et al. | 417/222.2 |
| 5,000,666 | 3/1991 | Esaki | 417/222.2 |
| 5,032,060 | 7/1991 | Kobayashi et al. | 417/222.1 |
| 5,173,032 | 12/1992 | Teguchi et al. | 417/222.2 |
| 5,232,349 | 8/1993 | Kimura et al. | 417/222.1 |
| 5,259,736 | 11/1993 | Terauchi | 417/270 |
| 5,267,839 | 12/1993 | Kimura et al. | 417/269 |
| 5,286,173 | 2/1994 | Takenaka et al. | 417/269 |
| 5,342,178 | 8/1994 | Kimura et al. | 417/222.2 |
| 5,358,450 | 10/1994 | Robert et al. | 417/269 |
| 5,362,208 | 11/1994 | Inagaki et al. | 417/269 |
| 5,380,166 | 1/1995 | Terauchi | 417/269 |
| 5,380,168 | 1/1995 | Kimura et al. | 417/269 |
| 5,419,685 | 5/1995 | Fujii et al. | 417/269 |

FOREIGN PATENT DOCUMENTS

| | | | |
|---|---|---|---|
| 64-56972 | 3/1989 | Japan | 417/222.2 |

*Primary Examiner*—Peter Korytnyk

*Attorney, Agent, or Firm*—Brooks Haidt Haffner & Delahunty

[57] ABSTRACT

A compressor has an internal refrigerant gas passage selectively connected to and disconnected with an external refrigerant circuit separately provided from the compressor. The compressor has a plurality of pistons reciprocable in a plurality of cylinder bores in a housing for compressing gas. The compressor comprises a drive shaft rotatably supported by the housing. A swash plate is supported on the drive shaft for integral rotation with inclining motion with respect to the drive shaft. The swash plate is movable between a maximum inclined angle and a minimum inclined angle. A rotary valve is disposed in the middle of the internal refrigerant gas passage for synchronously rotating with the drive shaft. The rotary valve has a refrigerant supply passage for sequentially supplying the refrigerant gas in the internal refrigerant gas passage to each cylinder bore. A disconnecting device disconnects the external refrigerant circuit from the internal refrigerant gas passage when the swash plate is at the minimum inclined angle.

20 Claims, 10 Drawing Sheets

PISTON TYPE VARIABLE DISPLACEMENT COMPRESSOR

CROSS REFERENCE TO RELATED APPLICATION

This application is a continuation in part application of the U.S. application Ser. No. 08/255,043 filed on Jun. 7, 1994, entitled SWASH PLATE TYPE COMPRESSOR.

BACKGROUND OF THE INVENTION

1. Field of the Invention

The present invention relates to a clutchless piston type variable displacement compressor, and more particularly, to a clutchless piston type variable displacement compressor which controls the inclined angle of a swash plate by utilizing the pressure differential between a crank chamber and a suction chamber to supply gas in a discharge pressure area to the crank chamber and to discharge the gas in the crank chamber to a suction pressure area, thereby adjusting the pressure in the crank chamber.

2. Description of the Related Art

In general, compressors are used in vehicles to supply compressed refrigerant gas to the vehicle's air conditioning system. To maintain air temperature inside the vehicle at a level comfortable for the vehicle's passengers, it is important to utilize a compressor whose displacement amount of the refrigerant gas is controllable. One known compressor of this type controls the inclined angle of a swash plate, tiltably supported on a drive shaft, based on the difference between the pressure in a crank chamber and the suction pressure, and converts the rotational motion of the swash plate to the reciprocal linear motion of each piston. In the conventional compressor, an electromagnetic clutch is provided between an external driving source, such as the vehicle's engine, and the rotary shaft of the compressor. Power transmission from the driving source to the rotary shaft is controlled by the ON/OFF action of this clutch. When power transmission from the driving source to the rotary shaft is interrupted, the compressor's displacement of refrigerant gas is set to zero.

At the time the electromagnetic clutch is activated or deactivated, the clutch's action generates a shock generally detrimental not only to the compressor but also to the overall driving comfort experienced by the vehicle's passengers. Further, the provision of the electromagnetic clutch increases the overall weight of the compressor.

To solve the above shortcoming, U.S. Pat. No. 5,173,032 discloses a compressor designed to set the displacement amount to zero without using an electromagnetic clutch. In such a clutchless system, the compressor runs even when no cooling is needed. With such type of compressors, it is important that when cooling is unnecessary, the discharge displacement be reduced as much as possible to prevent the evaporator from undergoing frosting. Under these conditions, it is also important to stop the circulation of the refrigerant gas through the compressor, and its external refrigeration circuit.

The compressor described in U.S. Pat. No. 5,173,032 is designed to block the flow of gas into the suction chamber in the compressor from the external refrigeration circuit by the use of an electromagnetic valve. This valve selectively allows for the circulation of the gas through the external refrigeration circuit and the compressor. When the gas circulation is blocked by the valve, the pressure in the suction chamber drops and the control valve responsive to that pressure opens fully. The full opening of the control valve allows the gas in the discharge chamber to flow into the crank chamber, which in turn raises the pressure inside the crank chamber. The gas in the crank chamber is supplied to the suction chamber. Accordingly, a short circulation path is formed which passes through the cylinder bores, the discharge chamber, the crank chamber, the suction chamber and back to the cylinder bores.

When the pressure in the suction chamber decreases as mentioned above, the pressure in the cylinder bores falls, causing an increase in the difference between the pressure in the crank chamber and the suction pressure in the cylinder bores. This pressure differential in turn minimizes the inclination of the swash plate which reciprocates the pistons. As a result, the discharge displacement and the driving torque needed by the compressor are minimized, thus reducing power loss as much as possible.

In the conventional compressor, a suction port located between each compression chamber and its associated suction chamber is opened and closed by a flapper valve disposed in that compression chamber, based on the pressure difference between the compression chamber and the suction chamber. More specifically, when the piston moves from the top dead center to the bottom dead center in the suction stroke, the pressure in the associated suction chamber becomes higher than the pressure in the associated compression chamber. As a result, the refrigerant gas in each suction chamber forces the associated flapper valve open and enters the associated compression chamber. When the piston moves from the bottom dead center to the top dead center in the discharge stroke, the associated flapper valve closes the associated suction port, causing the refrigerant gas in the compression chamber to be discharged through a discharge port into the associated discharge chamber.

Because the flapper valves have an elasticity, however, the pressure difference between each compression chamber and the associated suction chamber should be high enough to defeat the resilient force of each flapper valve in order to open the suction port. It takes time to produce such a pressure difference, thus delaying the opening of the suction port.

For lubrication inside the compressor, a lubricating oil mist is suspended in the refrigerant gas to lubricate the internal parts of the compressor. The lubricating oil enters between the suction ports and the associated flapper valves to enhance the contact force between the peripheral portions of the suction ports and the associated flapper valves. This delays the opening of the flapper valves. The delayed opening of the flapper valves reduces the flow rate of the refrigerant gas into the compression chambers, or reduces the volumetric efficiency of the compressor.

Further, even when the flapper valves are opened, the elastic resistance of the flapper valves also acts as a suction resistance to the flow of the refrigerant gas, thereby reducing the flow rate of the refrigerant gas or the volumetric efficiency of the compressor. The reduction in volumetric efficiency deteriorates the overall cooling performance of an apparatus equipped with the compressor. In vehicles in which such a compressor is mounted, for example, the engine speed is increased during idling to improve the cooling performance. The high engine speed during idling increases the fuel consumption.

SUMMARY OF THE INVENTION

Accordingly, it is an objective of the present invention to provide a compressor whose torque variation can be suppressed and whose volumetric efficiency can be improved by adjusting the flow rate of the refrigerant gas entering suction chambers.

To achieve the above objects, the compressor according to the present invention has an internal refrigerant gas passage selectively connected to and disconnected with an external refrigerant circuit separately provided from the compressor. The compressor has a plurality of pistons reciprocable in a plurality of cylinder bores in a housing for compressing gas. The compressor comprises a drive shaft rotatably supported by the housing. A swash plate is supported on the drive shaft for integral rotation with inclining motion with respect to the drive shaft. The swash plate is movable between a maximum inclined angle and a minimum inclined angle. A rotary valve is disposed in the middle of the internal refrigerant gas passage for synchronously rotating with the drive shaft. The rotary valve has a refrigerant supply passage for sequentially supplying the refrigerant gas in the internal refrigerant gas passage to each cylinder bore. A disconnecting means disconnects the external refrigerant circuit from the internal refrigerant gas passage when the swash plate is at the minimum inclined angle.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 4 1s a cross-sectional view taken along the line 4—4 in FIG. 1;

DETAILED DESCRIPTION OF THE PREFERRED EMBODIMENTS

Figure 1:
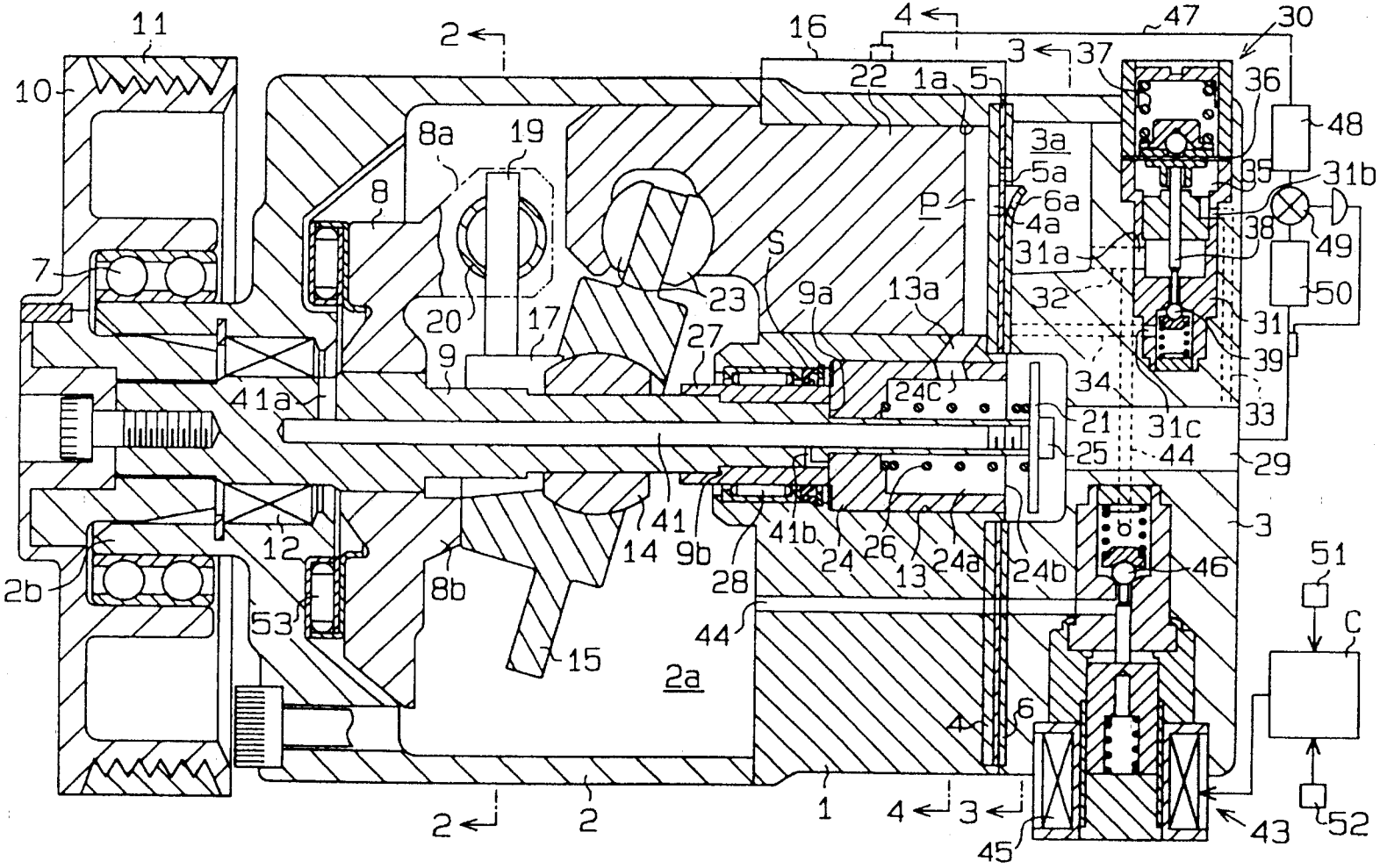
FIG. 1 is a side cross-sectional view of an overall compressor according to one embodiment of the present invention.

A compressor according to a first embodiment of the present invention will now be described. FIG. 1 presents a cross-sectional view showing the overall compressor. The outline of the compressor will be discussed with reference to FIG. 1. A cylinder block 1 constitutes a part of the housing of the compressor. A front housing 2 is secured to the front end of the cylinder block 1. A rear housing 3 is secured to the rear end of the cylinder block 1 via a first plate 4, a second plate 5, and a third plate 6. The front housing 2 defines a crank chamber 2*a*. A drive shaft 9 is supported rotatably on the front housing 2 and the cylinder block 1. The front end of the drive shaft 9 protrudes outside the crank chamber 2*a*, with a pulley 10 fastened on this front end. The pulley 10 is functionally coupled to the engine of a vehicle via a belt 11.

A support pipe 2*b* protrudes from the front end of the front housing 2 in such a way as to surround the front end of the drive shaft 9. The pulley 10 is supported via an angular bearing 7 on the support pipe 2*b*. Through the angular bearing 7, the support pipe 2*b* receives both the thrust load and radial load which act on the pulley 10.

Figure 2:
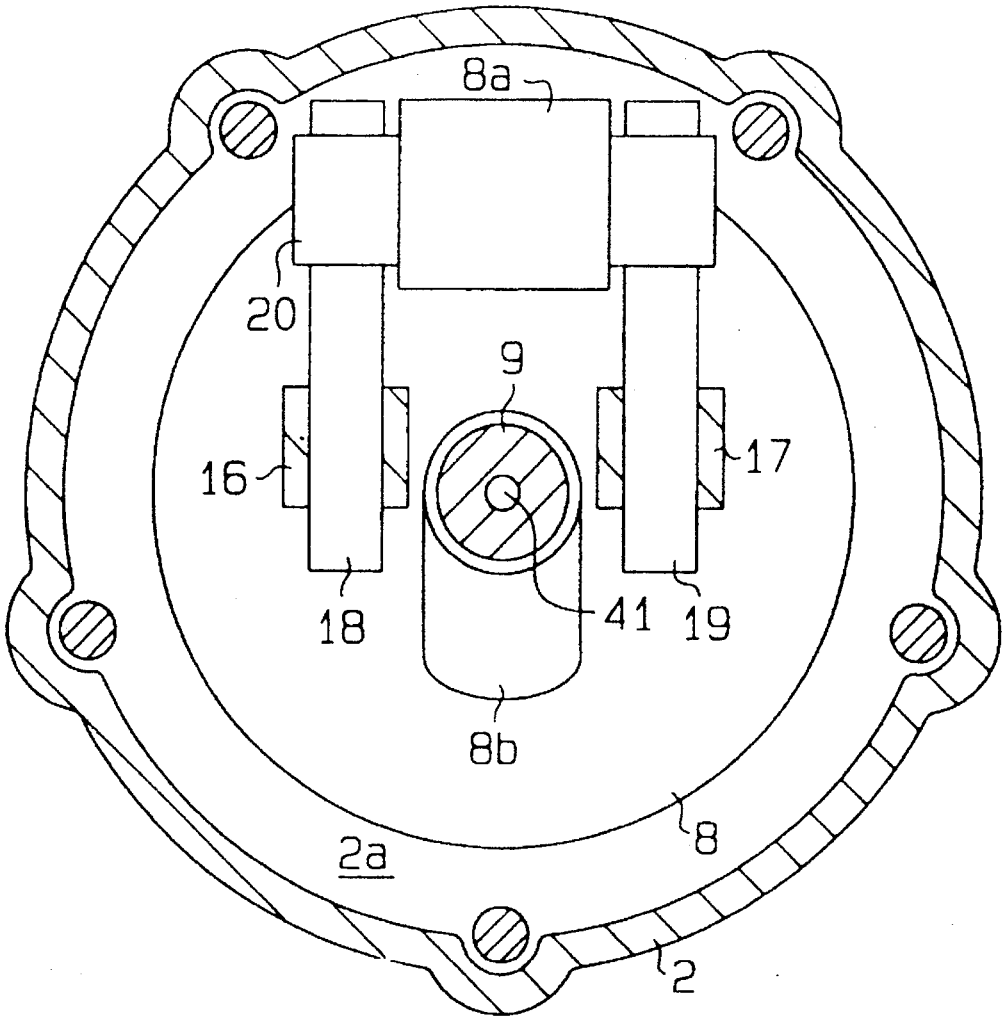
FIG. 2 is a cross sectional view taken along the line 2—2 in FIG. 1.

Between the front end of the drive shaft 9 and the front housing 2 is a lip seal 12, which prevents the pressure leakage from the crank chamber 2*a*. A drive plate 8 is mounted on the drive shaft 9. A support 14, having a spherical surface, is also supported in a slidable manner on the drive shaft 9. A swash plate 15 is supported on the support 14 in such a way as to be tiltable with respect to the drive shaft 9. As shown in FIG. 2, a pair of stays 16 and 17 are securely attached to the swash plate 15, with a pair of guide pins 18 and 19 respectively secured to the stays 16 and 17. Protruding from the drive plate 8 is an arm 8*a*. A connector 20 extends perpendicular to the axis of the drive shaft 9 and is rotatably supported by the arm 8*a*. The guide pins 18 and 19 are slidably fitted in both end portions of the connector 20. The swash plate 15 is tiltable about the support 14 with respect to the drive shaft 9 and is rotatable together with the drive shaft 9.

A plurality of cylinder bores 1*a* are formed through the cylinder block 1 so as to connect to the crank chamber 2*a*. A single-head piston 22 is retained in each cylinder bore 1*a*. The rotational motion of the drive shaft 9 is transmitted to the pistons 22 via the drive plate 8, the swash plate 15 and shoes 23, causing the pistons 22 to move forward and backward in the associated cylinder bores 1*a* in accordance with the inclination of the swash plate 15.

Figure 3:
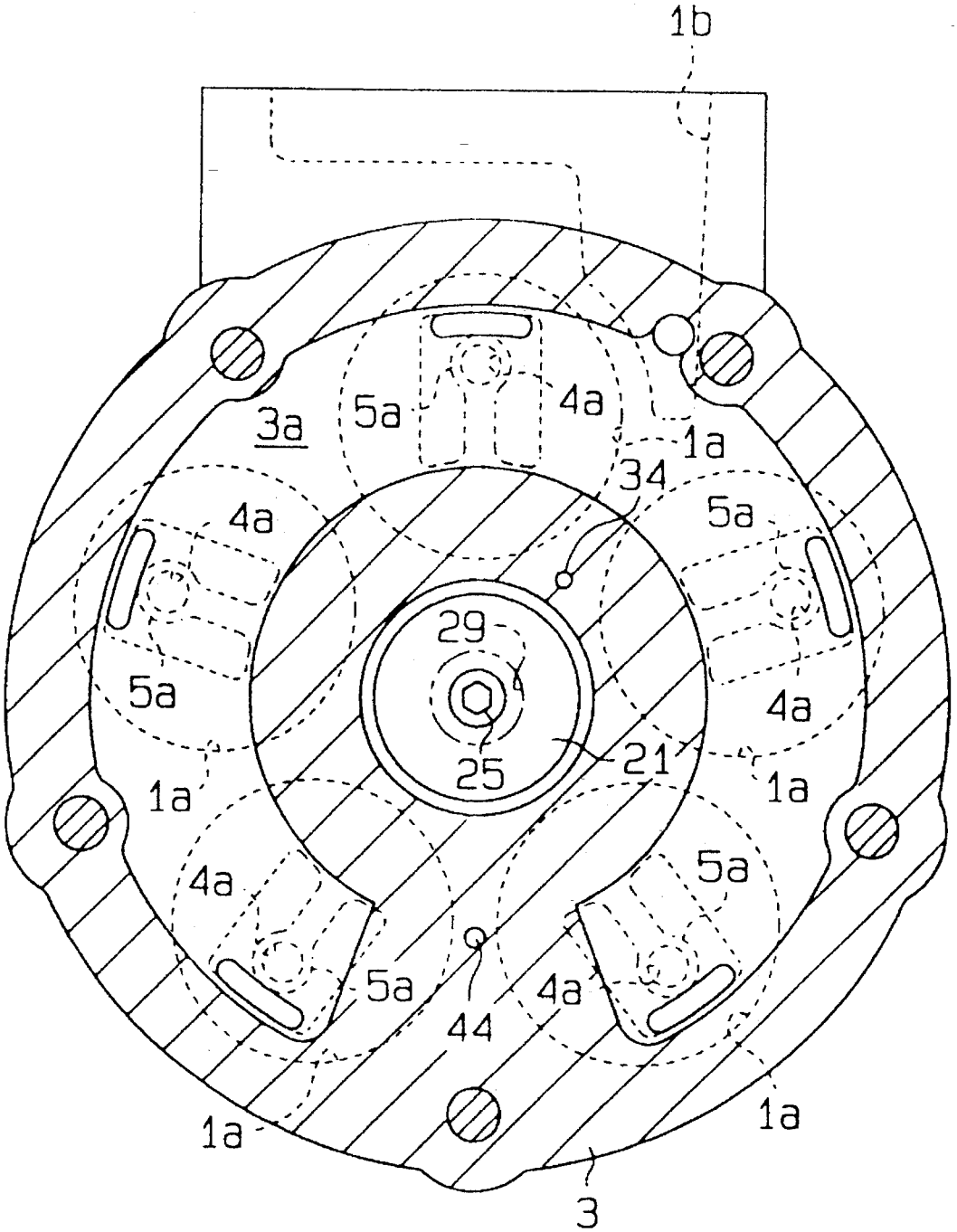
FIG. 3 is a cross-sectional view taken along the line 3—3 in FIG. 1.

As shown in FIGS. 1 and 3, a discharge chamber 3*a* is defined in the rear housing 3. A discharge port 4*a* is formed in the first plate 4, and a discharge valve 5*a* is formed on the second plate 5. A plurality of Compression chambers P are defined in the cylinder bores 1*a* by the pistons 22. As the pistons 22 move forward, the refrigerant gas in each compression chamber P forces the discharge valve 5*a* open through the discharge port 4*a* and enters the discharge chamber 3*a*. The discharge valve 5*a* abuts against a retainer 6*a* on the third plate 6, which limits the degree of opening of the discharge port 4*a*.

A thrust bearing 53 is located between the drive plate 8 and the front housing 2. This thrust bearing 53 receives the reaction force from each compression chamber P that acts on the drive plate 8 via the associated piston 22, the swash plate 15, the stays 16 and 17, the guide pins 18 and 19 and the connector 20.

A description will now be given of the structure which supplies the refrigerant gas to each cylinder bore la.

Figure 4:
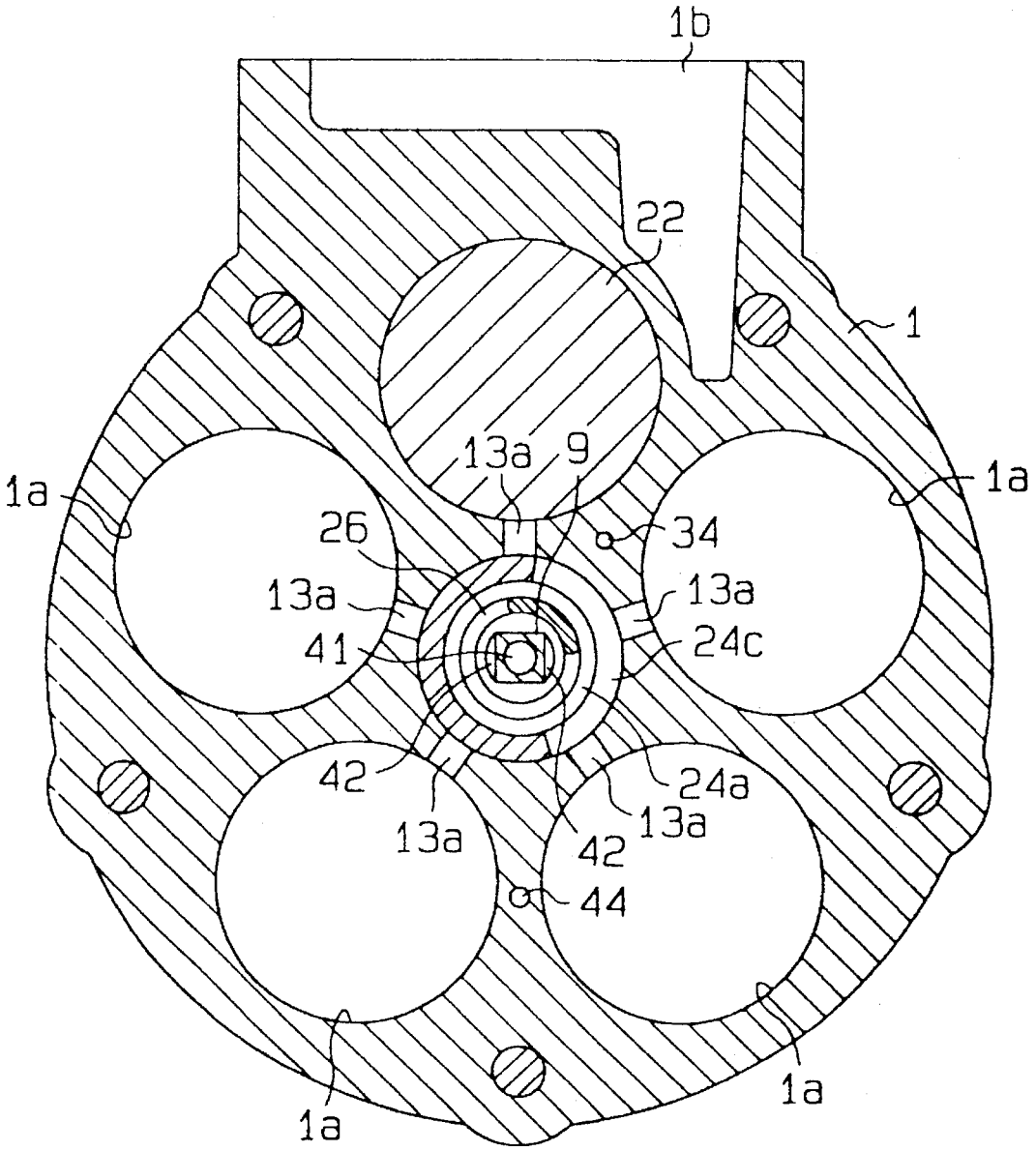
Figure 5:
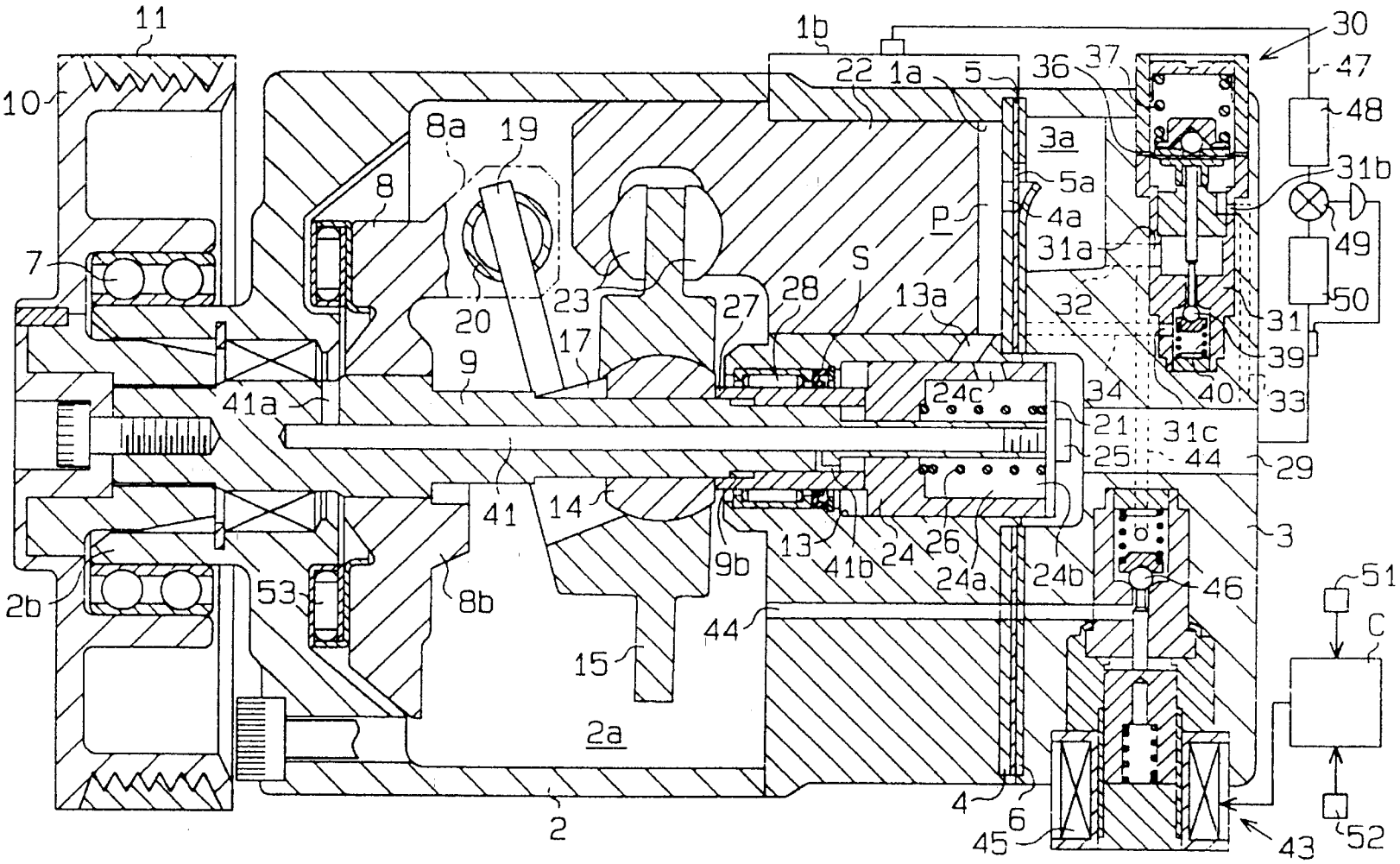
FIG. 5 is a side cross-sectional view of the whole compressor with its swash plate at the minimum inclined angle.
Figure 6:
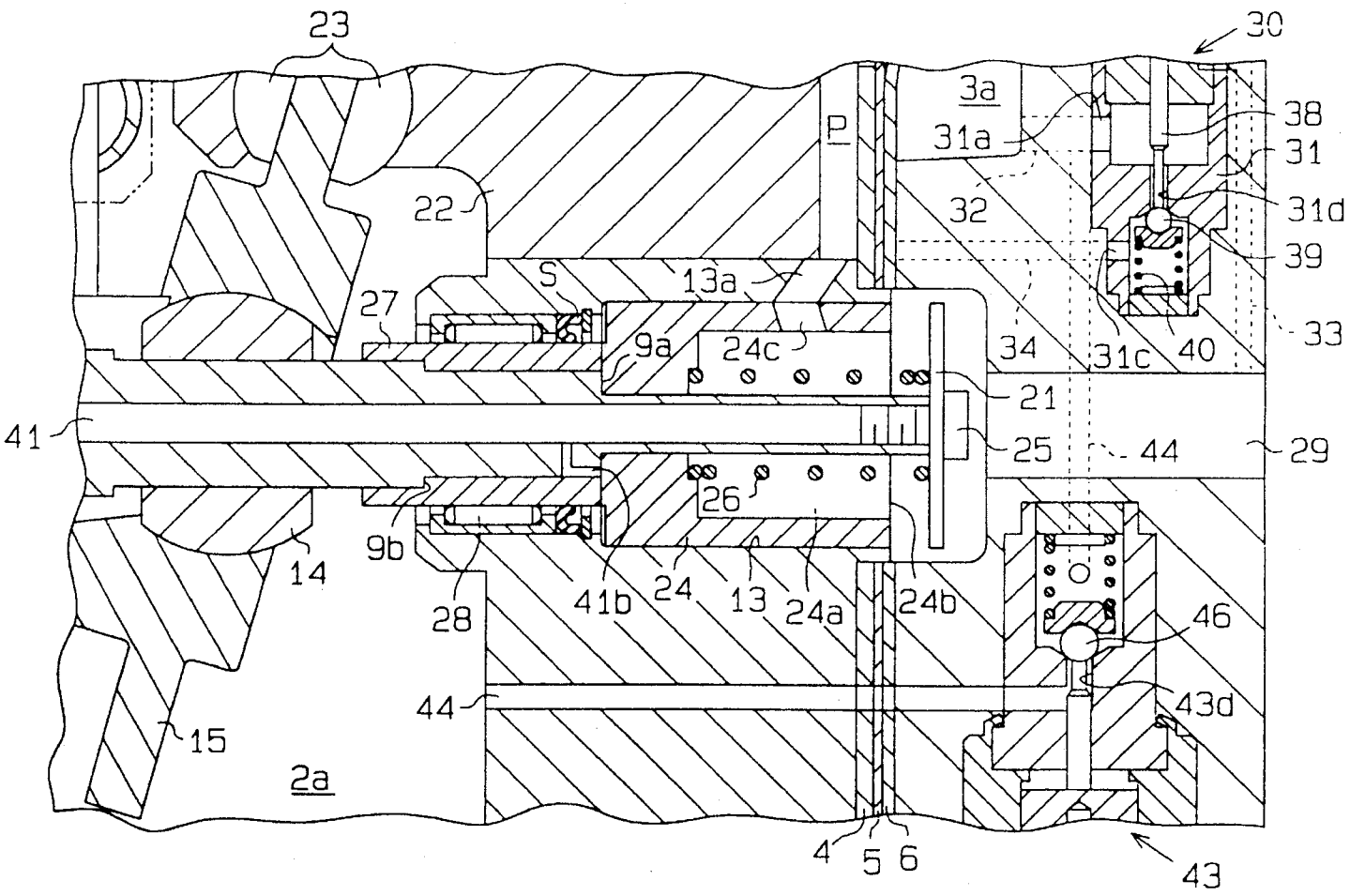
FIG. 6 is an enlarged cross-sectional view of essential parts showing a rotary valve at an open position.

As shown in FIGS. 1, 5 and 6, a hole 13 is formed in the center portion of the cylinder block 1 and extends in the axial direction of the drive shaft 9. A rotary valve 24 is placed in the hole 13 in a rotatable and slidable manner. A gas supply passage 24*a* is formed in the rotary valve 24, with its inlet 24*b* open at the rear end (the right hand end as viewed in FIG. 1) of the rotary valve 24. As shown in FIG. 4, the gas supply passage 24*a* has an outlet 24*c* open at the outer surface of the rotary valve 24.

A small-diameter portion formed at the rear end of the drive shaft 9 is fitted in the rotary valve 24. The rotary valve 24 is slidable on this small-diameter portion. A shutter plate 21 is fixed to the rear end of the drive shaft by means of a screw 25. Between the shutter plate 21 and the rotary valve 24 is a spring 26 which urges the rotary valve 24 toward the support 14. One end face of the rotary valve 24 is adapted to abut against the shutter plate 21. When the end face of the rotary valve 24 abuts against the shutter plate 21, the inlet 24*b* of the gas supply passage 24*a* is blocked by the shutter plate 21.

A pipe 27 is slidably supported on the drive shaft 9 between the support 14 and the rotary valve 24. The pipe 27 has a front end engageable with the rear end face of the support 14 and a rear end engageable with the front end face of the rotary valve 24. The pipe 27 is placed partially inside the hole 13, with a slide bearing 28 disposed between the inner wall of the hole 13 and the pipe 27. The slide bearing 28 receives the radial load to the drive shaft 9 via the pipe 27. A sealing member S is located between the slide bearing 28 and the rotary valve 24 to seal between the crank chamber 21*a* and the hole 13.

As shown in FIG. 6, first and second step portions 9*a* and 9*b* are formed on the outer surface of the drive shaft 9. The first step portion 9*a*, when in engagement with the rotary valve 24, restricts the movement of the rotary valve 24 toward the support 14 (the forward movement of the rotary valve 24). The second step portion 9*b*, when in engagement with the pipe 27, restricts the forward movement of the pipe 27.

Figure 7:
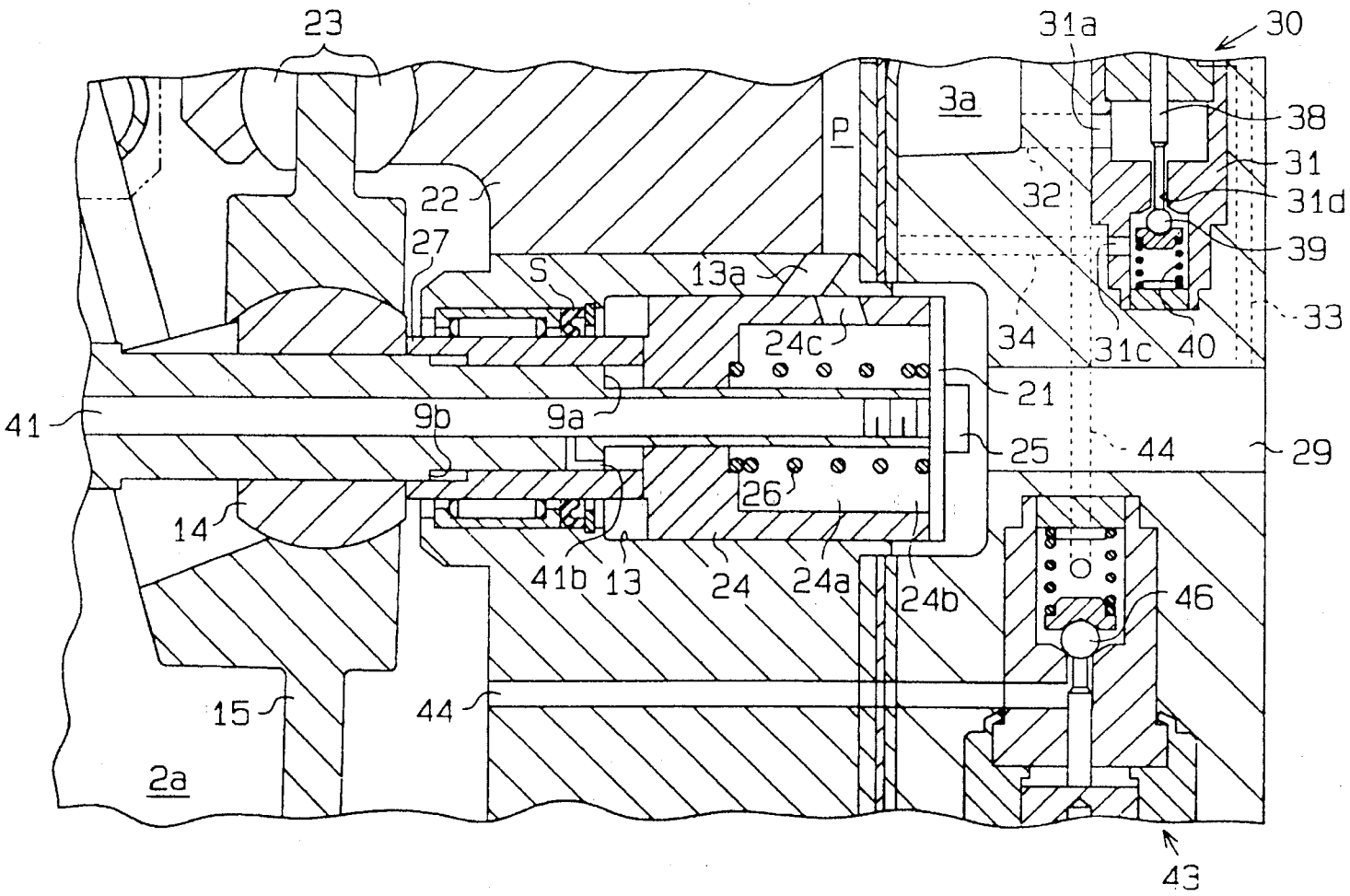
FIG. 7 is an enlarged cross-sectional view of essential parts showing the rotary valve at a closed position.

A suction passage 29 is formed in the center portion of the rear housing 3. The inlet 24*b* of the gas supply passage 24*a* is open to the suction passage 29. FIG. 7 shows the rear end face of the rotary valve 24 abutting against the shutter plate 21 so that the rotary valve 24 comes to the closed position. At this time, the rearward movement of the rotary valve 24 is restricted and the communication between the suction passage 29 and the gas supply passage 24*a* is blocked.

When the support 14 moves toward the shutter plate 21 by the undulation of the swash plate 15, the support 14 abuts against the pipe 27, pressing the pipe 27 against the rotary valve 24. Then, the rotary valve 24 moves into contact with the shutter plate 21 against the urging force of the spring 26. Accordingly, the rearward movement of the support 14 is restricted, setting the swash plate 15 nearly perpendicular to the drive shaft 9. The inclined angle of the swash plate 15 then is minimized. It is to be noted however that the minimum inclined angle of the swash plate 15 is slightly greater than zero degrees. When the rotary valve 24 comes to the closed position, the inclined angle of the swash plate 15 becomes minimum. The rotary valve 24 is shifted between the closed position and an open position in response to the undulation of the swash plate 15. The maximum inclined angle of the swash plate 15 is restricted by the contact of a projection 8*b* of the drive plate 8 with the swash plate 15.

As shown in FIGS. 1 and 4, the cylinder block 1 has a plurality of suction ports 13*a* each allowing communication between the associated compression chamber P and the hole 13. When the rotary valve 24 is at either the open position shown in FIG. 6 or the closed position shown in FIG. 7, the outlet 24*c* of the gas supply passage 24*a* in the rotary valve 24 is sequentially connected to the individual suction ports 13*a* in accordance with the rotation of the rotary valve 24. When the rotary valve 24 is at the open position, the refrigerant gas in the suction passage 29 is sequentially led into the individual compression chambers P via the gas supply passage 24*a* by the forward movement of the pistons 22.

The stroke of the piston 22 changes in accordance with the difference between the pressure in the crank chamber 2*a* and the suction pressure in the associated cylinder bore 1*a*. In accordance with this pressure difference, the inclined angle of the swash plate 15 changes, thus changing the compression displacement. The pressure in the crank chamber 2*a* is controlled by a displacement control valve 30 attached to the rear housing 3.

This displacement control valve 30 and the structure associated with it will now be described with reference to FIGS. 1 and 4. A valve housing 31 of the displacement control valve 30 has a first port 31*a*, a second port 31*b* and a control port 31*c*. The first port 31*a* communicates with the discharge chamber 3*a* via a passage 32. The second port 31*b* communicates with the suction passage 29 via a passage 33, and the control port 31*c* communicates with the crank chamber 2*a* via a control passage 34 (Note FIG. 4).

The pressure in a suction pressure detection chamber 35 which communicates with the second port 31*b* acts against an adjust spring 37 via a diaphragm 36. The urging force of the adjust spring 37 is transmitted to a valve body 39 via the diaphragm 36 and a rod 38. The valve body 39 is urged by a return spring 40 in the direction to close a valve hole 31*d* (see FIG. 6). The valve body 39 selectively opens or closes the valve hole 31*d* in accordance with a change-in suction pressure in the suction pressure detection chamber 35. When the valve hole 31*d* is closed, the communication between the first port 31*a* and the control port 31*c* is blocked, thereby disconnecting the discharge chamber 3*a* from the crank chamber 2*a*.

A pressure release passage 41 is formed in the drive shaft 9. The passage 41 has an inlet 41*a* open to the crank chamber 2*a*, and an outlet 41*b* open to the first step portion 9*a*. A gap 42 shown in FIG. 4 is formed between the outer surface of the rear end portion of the drive shaft 9 and the rotary valve 24 in the vicinity of the first step portion 9*a*. This gap 42 connects the outlet 41*b* of the passage 41 to the gas supply passage 24*a*. The crank chamber 2*a* therefore communicates with the gas supply passage 24*a* via the passage 41 and the gap 42.

An electromagnetic valve 43 is attached to the rear housing 3. This electromagnetic valve 43 is located nearly midway along a passage 44. When a solenoid 45 of the electromagnetic valve 43 is excited or activated, the valve body 46 closes the valve hole 43*a*. When the solenoid 45 is de-excited or deactivated, the valve body 46 opens the valve hole 43*a*. Therefore, the electromagnetic valve 43 selectively opens or blocks the passage 44 that connects the discharge chamber 3*a* to the crank chamber 2*a*.

An outlet port 1*b* allows the refrigerant gas to be discharged from the discharge chamber 3*a*. This outlet port 1*b* and the aforementioned suction passage 29 are connected by an external refrigeration circuit 47, which has a condenser 48, an expansion valve 49 and an evaporator 50. The expansion valve 49 controls the flow rate of the refrigerant gas in accordance with a change in gas pressure on the outlet side of the evaporator 50.

A computer C controls the solenoid 45 of the electromagnetic valve 43. More specifically, the computer C activates the solenoid 45 in response to the ON action of a start switch 51 for activating the air conditioning system or the OFF action of an accelerator switch 52 of the vehicle. The computer C deactivates the solenoid 45 in response to the OFF action of the start switch 51 or the ON action of the accelerator switch 52. FIG. 1 shows the solenoid 45 being activated, and the passage 44 is closed in this case.

The function of the compressor with the passage 44 closed will be described below.

When the cooling load is high and the pressure in the suction passage 29 or the suction pressure is high, the pressure in the suction pressure detection chamber 35 rises and the amount of opening of the valve hole 31*d* by the valve body 39 becomes smaller. This reduces the amount of the refrigerant gas flowing into the crank chamber 2*a* from the discharge chamber 3*a* via the passage 32, the first port 31*a*, the valve hole 31*d*, the control port 31*c* and the control passage 34. Further, the refrigerant gas in the crank chamber 2*a* flows out to the gas supply passage 24*a* via the pressure release passage 41. The pressure in the crank chamber 2*a* therefore falls. As the suction pressure in each cylinder bore 1*a* is high, the difference between the pressure in the crank chamber 2*a* and the suction pressure in the cylinder bore 1*a* becomes smaller. This increases the inclined angle of the swash plate 15 as shown in FIGS. 1 and 6.

On the contrary, when the cooling load is low and the suction pressure is low, the amount of opening of the valve hole 31*d* by the valve body 39 becomes greater and the amount of the refrigerant gas flowing into the crank chamber 2*a* from the discharge chamber 3*a* increases. This increases the pressure in the crank chamber 2*a*. As the suction pressure in each cylinder bore 1*a* is low, the difference between the pressure in the crank chamber 2*a* and the suction pressure in the cylinder bore 1*a* increases. This reduces the inclined angle of the swash plate 15.

When there is no cooling load and the suction pressure becomes extremely low, the amount of opening of the valve hole 31*d* by the valve body 39 approaches to the maximum level. Under this situation, the refrigerant gas in the discharge chamber 3*a* rapidly flows into the crank chamber 2*a* via the control passage 34, quickly raising the pressure in the crank chamber 2*a*. Consequently, the swash plate 15 and the support 14 move rearward, reducing the inclined angle of the swash plate 15.

As the inclined angle of the swash plate 15 decreases, the support 14 abuts on the pipe 27 which in turn abuts on the rotary valve 24. When the support 14 moves further rearward under this situation, the rotary valve 24 approaches the shutter plate 21. Consequently, the cross-sectional area between the suction passage 29 and the gas supply passage 24*a* where the refrigerant gas passes decreases gradually and the amount of the refrigerant gas flowing into the gas supply passage 24*a* from the suction passage 29 gradually decreases. This also slowly reduces the amount of the refrigerant gas led into each compression chamber P from the gas supply passage 24*a* via the associated suction port 13*a*, resulting the slow reduction in discharge displacement. As a result, the discharge pressure gradually falls so that the torque in the compressor does not greatly change in a short period of time.

When the rotary valve 24 keeps approaching the shutter plate 21 and hits against this plate 21 at last, the communication between the suction passage 29 and the gas supply passage 24*a* is blocked, hindering the circulation of the refrigerant gas in the external refrigeration circuit 47. Therefore, there is no chance of causing frosting in the evaporator 50.

The refrigerant gas discharged to the discharge chamber 3*a* from each cylinder bore 1*a* flows into the crank chamber 2*a*, passing through the passage 32, the passage in the displacement control valve 30 and the control passage 34. The refrigerant gas in the crank chamber 2*a* flows to the gas supply passage 24*a* through the pressure release passage 41 and the gap 42. After the refrigerant gas in the gas supply passage 24*a* is led into each compression chamber P, the refrigerant gas is discharged to the discharge chamber 3*a*.

As apparent from the above, with the minimum inclined angle of the swash plate 15 (when the swash plate is nearly perpendicular to the drive shaft 9), a gas circulation route connecting the discharge chamber 3*a*, the passage 32, the passage in the displacement control valve 30, the control passage 34, the crank chamber 2*a*, the pressure release passage 41, the gap 42, the gas supply passage 24*a* and the compression chambers P is formed. There are pressure differences among the discharge chamber 3*a*, the crank chamber 2*a* and the gas supply passage 24*a*.

According to this embodiment, the passage 33 which connects the displacement control valve 30 to the suction passage 29 is provided upstream of the shutter plate 21 in order to communicate the suction pressure to the displacement control valve 30. Therefore, the displacement control valve 30 can always detect the suction pressure that reflects the cooling load. If any cooling load is produced, therefore, the inclined angle of the swash plate 15 can be rapidly and automatically increased.

Figure 8:
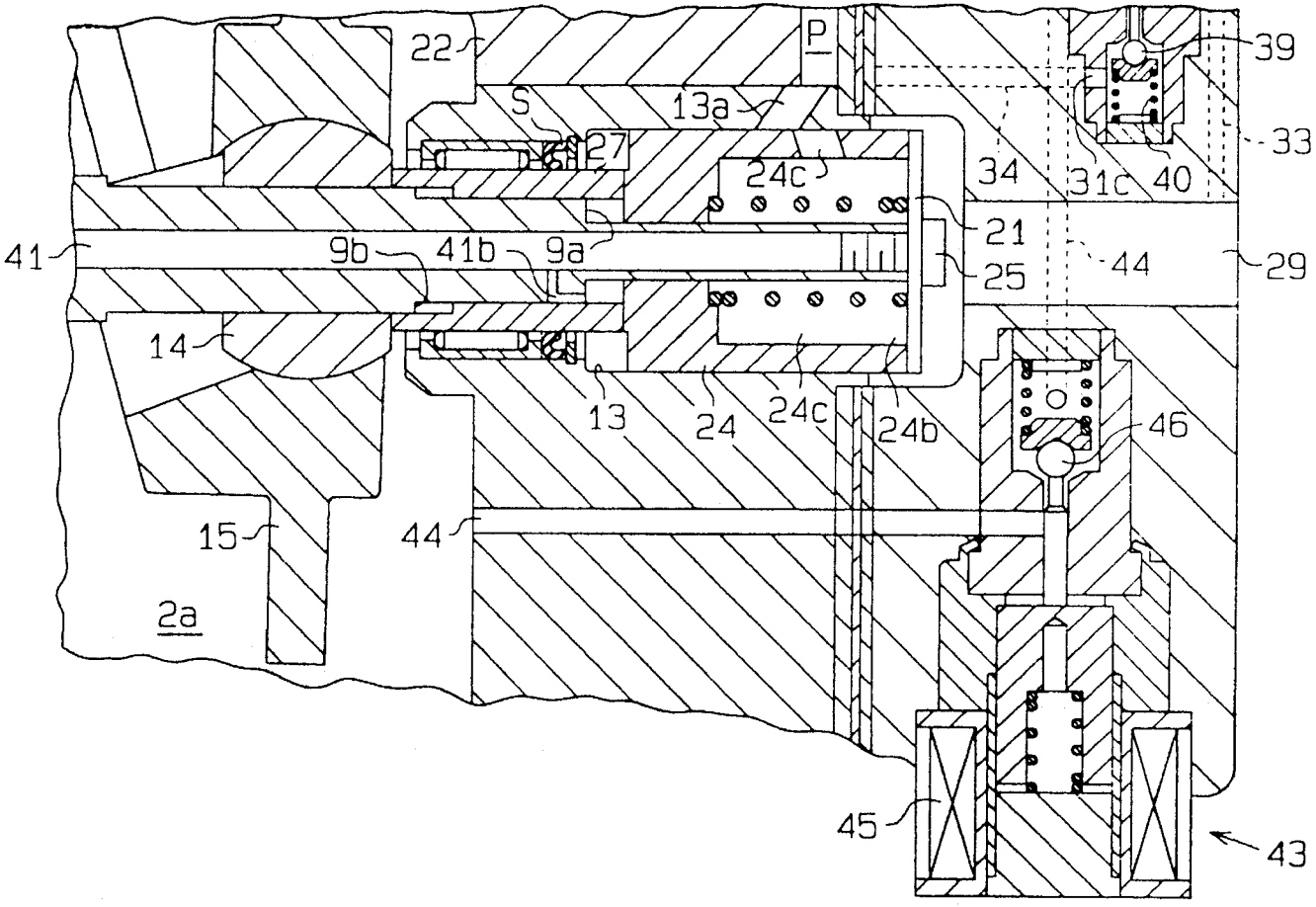
FIG. 8 is an enlarged cross-sectional view of essential parts showing a deactivated solenoid.

When the solenoid 45 is deactivated by the OFF action of the start switch 51 or the ON action of the accelerator switch 52 in this embodiment, the valve body 46 of the electromagnetic valve 43 opens the passage 44 as shown in FIG. 8. Under this condition, the refrigerant gas in the discharge chamber 3a rapidly flows into the crank chamber 2*a* via the passage 44. This decreases the inclined angle of the swash plate 15 to the minimum.

When the cooling load increases and the suction pressure in the suction passage 29 rises with the valve hole 31*d* opened by the valve body 39, the valve hole 31*d* is closed by the valve body 39 as shown in FIG. 7. Alternatively, when the start switch 51 is set on or the accelerator switch 52 is set off with the passage 44 opened by the valve body 46, the solenoid 45 is activated, causing the valve body 39 to block the passage 44 as shown in FIG. 8.

As mentioned above, there are pressure differences among the discharge chamber 3*a*, the crank chamber 2*a* and the gas supply passage 24*a*. If the passage 44 is blocked and the valve hole 31*d* is closed by the valve body 39 under the condition, the pressure in the crank chamber 2*a* falls and the inclined angle of the swash plate 15 becomes greater than the minimum inclined angle. The increase in inclined angle causes the support 14 to move away from the pipe 27. Due to the urging force of the spring 26, the rotary valve 24 moves in response to the movement of the pipe 27 and comes apart from the shutter plate 21. The movement of the rotary valve 24 gradually increases the size of the gas passage between the suction passage 29 and the gas supply passage 24a. This gradually increases the flow rate of the refrigerant gas to the passage 24*a* and the amount of the refrigerant gas that is led into each compression chamber P. Thus, the discharge displacement and the discharge pressure are slowly increased. Accordingly, the torque on the drive shaft 9 does not change sharply in a short period of time.

To supply the refrigerant gas into each cylinder bore 1*a*, the rotary valve 24 is employed. Unlike the conventional flapper type suction valve, this rotary valve 24 improves the volumetric efficiency in the compressor. The rotary valve 24 can supply the refrigerant gas to each compression chamber P immediately when the pressure in that compression chamber P slightly falls below the pressure in the gas supply passage 24*a*.

The improved volumetric efficiency improves the cooling performance. With the compressor-mounted vehicle idling, the cooling performance can be increased without increasing the engine speed and fuel consumption can be reduced.

Figure 9:
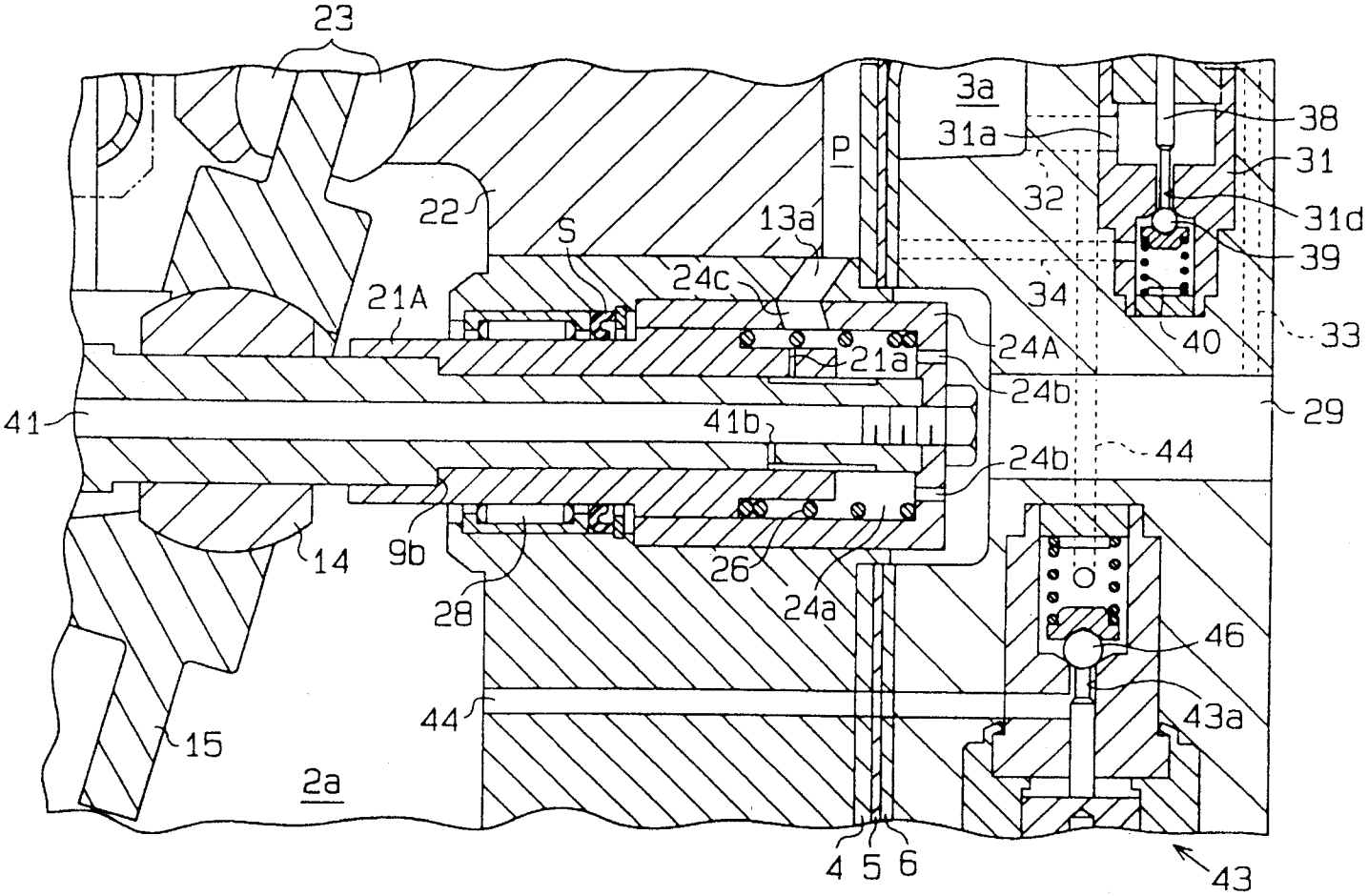
FIG. 9 is an enlarged cross-sectional view of essential parts showing another embodiment.
Figure 10:
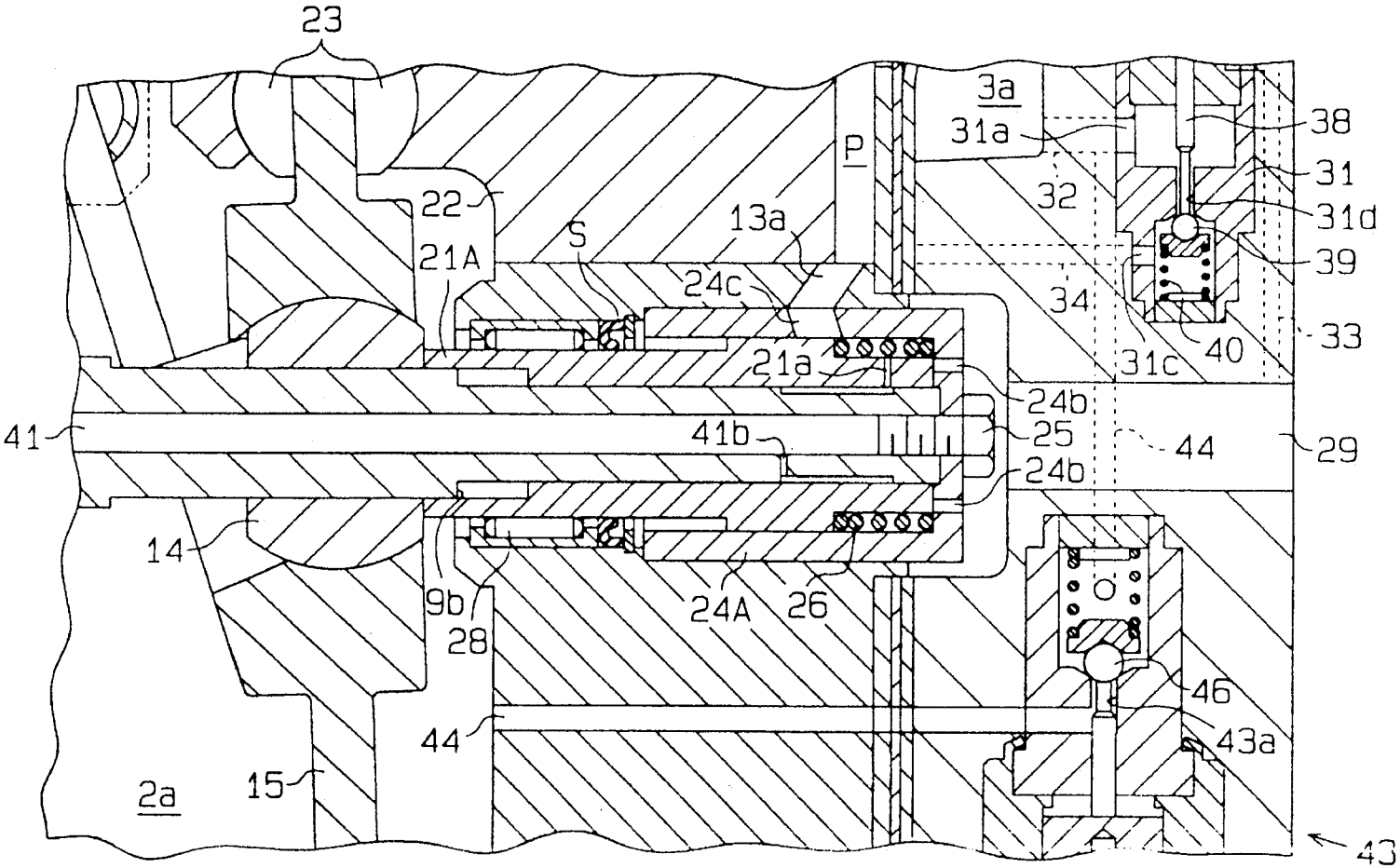
FIG. 10 is an enlarged cross-sectional view of essential parts showing a shutter plate at a closed position.

The present invention is not limited to the above-described embodiments, but may, for example, be embodied in the form shown in FIGS. 9 and 10. A rotary valve 24A in this embodiment is shaped like a cap whose top is securely fastened to the rear end of the drive shaft 9 by a screw 25. The inlet 24*b* of the gas supply passage 24 *a* is formed in the top of the rotary valve 24A. A sleeve 21A is slidably supported on the drive shaft 9 and is fitted in the gas supply passage 24*a* of the rotary valve 24A. The sleeve 21A is designed to be responsive to the inclination of the swash plate 15. A spring 26 is located between the rotary valve 24A and the sleeve 21A. As shown in FIG. 9, when the swash plate 15 is at the maximum inclined angle, the urging force of the spring 26 places the sleeve 21A at the open position apart from the inlet 24*b* of the gas supply passage 24*a*. As shown in FIG. 10, when the swash plate 15 is at the minimum inclined angle, the sleeve 21A is placed at the closed position to close the inlet 24*b* of the gas supply passage 24*a*. A pressure release hole 21*a* is provided in the sleeve 21A and is connected to an outlet 41*b* of a passage 41. When the swash plate 15 is at the minimum inclined angle, a gas circulation route is formed by the compression chambers P, the discharge chamber 3*a*, the passage 32, the passage within the control valve 30, the control passage 34, the crank chamber 2*a*, the pressure release passage 41 and the gas supply passage 24*a*. A pressure release hole 21*a* keeps the compression chambers P connected to the passage 41.

In this modification, the rotary valve 24A does not slide along the axis of the hole 13 but merely rotates in the hole 13. The sealing between the rotary valve 24 and the inner wall of the hole 13 is improved as compared with the structure where the rotary valve 24 slides in the hole 13.

Therefore, the present examples and embodiments are to be considered as illustrative and not restrictive and the invention is not to be limited to the details given herein, but may be modified within the scope of the appended claims.

What is claimed is:

1. A compressor having an internal refrigerant gas passage selectively connected to and disconnected with an external refrigerant circuit separately provided from the compressor, said compressor having a plurality of pistons reciprocable in a plurality of cylinder bores in a housing for compressing gas, said compressor comprising:

a drive shaft rotatably supported by the housing;

a swash plate supported on the drive shaft for integral rotation with inclining motion with respect to the drive shaft, said swash plate being movable between a maximum inclined angle and a minimum inclined angle;

a rotary valve disposed in the middle of the internal refrigerant gas passage for synchronously rotating with the drive shaft, said rotary valve having a refrigerant supply passage for sequentially supplying the refrigerant gas in the internal refrigerant gas passage to each cylinder bore; and disconnecting means for disconnecting the external refrigerant circuit from the internal refrigerant gas passage when the swash plate is at the minimum inclined angle.

2. A compressor according to claim 1 further comprising control means for detecting a pressure sucked in the internal refrigerant gas passage to control the inclined angle of the swash plate.

3. A compressor according to claim 2, wherein said disconnecting means is disposed downstream of a position where said control means detects the pressure in the internal refrigerant gas passage.

4. A compressor according to claim 3, wherein said control means includes a valve which is opened in response to the pressure sucked from the external refrigerant circuit into the internal refrigerant gas passage.

5. A compressor according to claim 1 further comprising actuating means for driving the swash plate in accordance with an electric signal indicative of the operating conditions of the compressor.

6. A compressor having an internal refrigerant gas passage selectively connected to and disconnected with an external refrigerant circuit separately provided from the compressor, said compressor having a plurality of reciprocable pistons for compressing gas, said compressor comprising:

a housing having a discharge chamber and a refrigerant suction;

a crank chamber defined in the housing;

a plurality of cylinder bores formed in the housing, each cylinder bore communicating to the discharge chamber and the refrigerant suction passage and accommodating each piston;

a drive shaft rotatably supported by the housing;

a swash plate supported on the drive shaft for integral rotation with inclining motion with respect to the drive shaft, said swash plate being movable between a maximum inclined angle and a minimum inclined angle;

a rotary valve disposed in the middle of the internal refrigerant gas passage for synchronously rotating with the drive shaft, said rotary valve having a refrigerant supply passage for sequentially supplying the refrigerant gas in the internal refrigerant gas passage to each cylinder bore; and disconnecting means for disconnecting said external refrigerant circuit from the internal refrigerant gas passage when the swash plate is at the minimum inclined angle.

7. A compressor according to claim 6, wherein said internal refrigerant gas passage includes:

a first passage for connecting the crank chamber and the refrigerant suction passage to deliver the refrigerant gas from the crank chamber to the refrigerant suction passage;

a second passage for connecting the discharge chamber and the crank chamber to deliver the refrigerant gas from the discharge chamber to the crank chamber; and a circulating passage including the first and the second passages, said circulating passage being formed upon disconnection of the external refrigerant circuit from the internal refrigerant gas passage.

8. A compressor according to claim 7 further including:

said external refrigerant circuit being connected to the refrigerant suction passage for supplying the refrigerant gas to the refrigerant suction passage; and an exhaust port for connecting the discharge chamber to the external refrigerant circuit to discharge the refrigerant gas from the discharge chamber to the external refrigerant circuit.

9. A compressor according to claim 7 further comprising actuating means for selectively opening and closing the second passage.

10. A compressor according to claim 9 further comprising a computer separately provided from the compressor, said computer being electrically connected to the compressor and computing conditions relative to the operation of the compressor.

11. A compressor according to claim 10, wherein said computer outputs electric signals indicative of the operational conditions of the compressor to the actuating means in order to drive the actuating means.

12. A compressor according to claim 9, wherein said actuating means includes an electromagnetic valve.

13. A compressor according to claim 6 further comprising control means for detecting a pressure sucked in the internal refrigerant gas passage to control the inclined angle of the swash plate.

14. A compressor according to claim 13, wherein said disconnecting means is disposed downstream of a position where said control means detects the pressure in the internal refrigerant gas passage.

15. A compressor according to claim 14, wherein said control means includes a valve which is opened in response to the pressure sucked from the external refrigerant circuit into the internal refrigerant gas passage.

16. A compressor according to claim 6, wherein said disconnecting means has a movable member movable along the internal refrigerant gas passage, said movable member and said rotary valve being movably supported on the drive shaft in an axial direction of the drive shaft, and wherein said movable member moves together with the rotary valve according to a change of the inclined angle of the swash plate and shuts off the cylinder bores from the refrigerant suction passage when the swash plate at the minimum angle.

17. A compressor according to claim 16, wherein said movable member shuts off the refrigerant supply passage from the refrigerant suction passage when the swash plate is at the minimum inclined angle.

18. A compressor according to claim 17, wherein said movable member includes:

a pipe disposed between the swash plate and the rotary valve and being movable on the drive shaft in accordance with the change of the inclined angle of the swash plate, and wherein said pipe moves the rotary valve on the drive shaft based on the movement of the pipe; and a shutter member mounted on the drive shaft between the rotary valve and the refrigerant suction passage, and wherein said shutter member selectively opens and closes the refrigerant suction passage in accordance with the movement of the rotary valve.

19. A compressor according to claim 18, wherein said movable member includes a spring disposed between the rotary valve and the shutter member for urging the rotary valve toward the pipe.

20. A compressor according to claim 6, wherein said disconnecting means includes:

a movable member movable along the internal refrigerant gas passage;

a shutter plate formed integrally with the rotary valve, said shutter plate having a plurality of holes communicating the refrigerant suction passage and the refrigerant supply passage; and wherein said movable member closes the holes when the movable member moves on the drive shaft in accordance with the change of the inclined angle of the swash plate.

* * * * *